US006588174B2

(12) United States Patent
Yamamoto et al.

(10) Patent No.: US 6,588,174 B2
(45) Date of Patent: Jul. 8, 2003

(54) WEB POSITION MATCHING SYSTEM AND PACKAGING MACHINE EQUIPPED WITH THE SYSTEM

(75) Inventors: Hidekimi Yamamoto, Tokushima (JP); Masaru Yoshioka, Tokushima (JP); Akimasa Fujimoto, Tokushima (JP); Michio Ueda, Tokushima (JP)

(73) Assignee: Shikoku Kakoki Co., Ltd., Tokushima (JP)

( * ) Notice: Subject to any disclaimer, the term of this patent is extended or adjusted under 35 U.S.C. 154(b) by 32 days.

(21) Appl. No.: 09/873,262

(22) Filed: Jun. 5, 2001

(65) Prior Publication Data

US 2001/0049920 A1 Dec. 13, 2001

(30) Foreign Application Priority Data

Jun. 6, 2000 (JP) ..... 2000-168424

(51) Int. Cl.[7] ..... B65B 57/00
(52) U.S. Cl. ..... 53/51; 53/55; 53/64; 53/66
(58) Field of Search ..... 53/51, 64, 66, 53/55, 389.4, 451, 551; 493/24

(56) References Cited

U.S. PATENT DOCUMENTS

| | | | | | |
|---|---|---|---|---|---|
| 3,787,001 | A | * | 1/1974 | Henry | 242/417.2 |
| 4,033,522 | A | * | 7/1977 | Chesnut et al. | 242/418 |
| 4,262,474 | A | * | 4/1981 | Reuter et al. | 53/551 |
| 4,754,593 | A | | 7/1988 | Ishihara et al. | 53/51 |
| 5,727,366 | A | | 3/1998 | Manly, Jr. | 53/451 |
| 5,756,979 | A | * | 5/1998 | Murakami et al. | 235/454 |
| 5,971,905 | A | * | 10/1999 | Fukuda | 493/3 |
| 5,992,131 | A | * | 11/1999 | Iwano et al. | 53/451 |
| 6,079,188 | A | * | 6/2000 | Katayama et al. | 53/451 |

FOREIGN PATENT DOCUMENTS

| | | |
|---|---|---|
| EP | 0 274 849 | 7/1988 |
| EP | 0 348 065 | 12/1989 |
| EP | 0 930 223 | 9/1999 |
| JP | 43-27194 | 11/1943 |

OTHER PUBLICATIONS

Copy of European Search Report for corresponding European Patent Application No. 01 20 2159 dated Oct. 2, 2001.

* cited by examiner

*Primary Examiner*—Scott A. Smith
*Assistant Examiner*—Nathaniel Chukwurah
(74) *Attorney, Agent, or Firm*—Armstrong, Westerman & Hattori, LLP

(57) ABSTRACT

A web position matching system for matching marks provided on a web of packaging material with a pitch corresponding to the length of one container, to a reference position comprises sensor device for detecting the displacement of the mark from the reference position, setting device for setting a usual amount of feed obtained by adding a predetermined amount of advance to a predetermined reference amount of feed corresponding to the length of one container when the displacement detected by the sensor device is smaller than a predetermined allowable displacement or setting a corrected amount of feed obtained by subtracting a predetermined amount of delay from the reference amount of feed when the detected displacement are not smaller than the allowable displacement, and device for correcting the usual amount of feed and the corrected amount of feed based on a pattern of frequencies with which the usual amount of feed and the corrected amount of feed are set by the setting device.

5 Claims, 9 Drawing Sheets

WEB POSITION MATCHING SYSTEM AND PACKAGING MACHINE EQUIPPED WITH THE SYSTEM

BACKGROUND OF THE INVENTION

The present invention relates to a position matching system for matching marks, which are provided on a web of packaging material with a pitch corresponding to the length of one container, to a reference position, and to packaging machines including the system and adapted to make the web of packing material into a tube, fill contents into the tube, transport the filled tube a distance at a time which distance corresponds to the length of one container, seal and sever the tube transversely thereof to form a pillowlike container, and eventually form the pillowlike container into a rectangular parallelepipedal container.

As disclosed, for example, in JP-B43-27194(1968), web position matching systems of the type mentioned and already known comprise sensor means for detecting the displacement of the mark from the reference position, and setting means for setting a usual amount of feed obtained by adding a predetermined amount of advance to a predetermined reference amount of feed corresponding to the length of one container when the displacement detected by the sensor means is smaller than a predetermined allowable displacement or setting a corrected amount of feed obtained by subtracting a predetermined amount of delay from the reference amount of feed when the detected displacement is not smaller than the allowable displacement.

The displacement of the mark from the reference position occurs frequently due, for example, to the slippage of the web during transport, disturbances such as variations in tension, or errors in the pitch of marks.

For example, if the mark pitch is shorter than the length of one container, the mark is displaced to a position downstream from the reference position, whereas if the mark pitch is longer than the length of one container, the mark is displaced to a position upstream from the reference position. Such a displacement occurs due not only to mark pitch errors but also to disturbances. For the convenience of description, however, the displacement will be handled herein as being attributable to an error in mark pitch.

With the conventional system, the amount of feed of the web is set in two steps, i.e., the usual amount of feed and the corrected amount of feed, which are repeated in a mode so that the marks will not be displaced from the reference position by more than an allowable amount. However, the system has the problem that the displacement, if great, is not absorbable or requires time for absorption.

Further when the amount of advance is set, for example, at +0.5 mm and the amount of delay at −1.0 mm in the conventional system, and if the mark pitch is shorter than the reference amount of feed by 0.5 mm, the web will be fed apparently 1.0 mm more than the reference amount of feed at a time, and this difference will be barely absorbed with the set amount of delay of −1.0 mm. Accordingly, if the mark pitch is shorter than the reference amount of feed by at least 0.5 mm, the displacement can not always be absorbed. Conversely if the mark pitch is 0.5 mm longer than the reference amount of feed, this difference can be barely absorbed by the set amount of advance of +0.5 mm, and if the mark pitch is more than 0.5 mm longer than the reference amount of feed, the difference is not absorbable.

SUMMARY OF THE INVENTION

An object of the present invention is to overcome the above problems and to provide a web position matching system which is adapted to absorb the displacement of marks reliably and within a short period of time even if the displacement is great and also packaging machines equipped with the system.

The present invention provides a web position matching system for matching marks provided on a web of packaging material with a pitch corresponding to the length of one container, to a reference position, the system comprising sensor means for detecting the displacement of the mark from the reference position, setting means for setting a usual amount of feed obtained by adding a predetermined amount of advance to a predetermined reference amount of feed corresponding to the length of one container when the displacement detected by the sensor means is smaller than a predetermined allowable displacement or setting a corrected amount of feed obtained by subtracting a predetermined amount of delay from the reference amount of feed when the detected displacement is not smaller than the allowable displacement, and means for correcting the usual amount of feed and the corrected amount of feed based on a pattern of frequencies with which the usual amount of feed and the corrected amount of feed are set by the setting means.

With the web position matching system of the invention, the amount of feed of the web is set in two steps, i.e., the usual amount of feed and the corrected amount of feed, and is so set as to correct the usual amount of feed and the corrected amount of feed based on a pattern of frequencies with which the usual amount of feed and the corrected amount of feed are set by the setting means. Accordingly, the amount of feed of the web is set in at least three steps. This makes it possible to control the amount of feed of the web finely and to absorb the displacement of marks reliably within a short period of time even if the displacement is great.

The pattern may be judged based on the deviation of the apparent amount of feed of the mark due, for example, to an error in mark pitch from the usual amount of feed.

Preferably, the usual amount of feed and the corrected amount of feed are corrected by zero when the apparent amount of feed is equal to the usual amount of feed, the usual amount of feed and the corrected amount of feed are corrected by subtracting a predetermined correcting amount when the apparent amount of feed is in excess of the usual amount of feed, or the usual amount of feed and the corrected amount of feed are corrected by adding a predetermined correcting amount when the apparent amount of feed is less than the usual amount of feed.

The mode of feeding is judged as being a normal mode when the number of times the setting means actually sets the usual amount of feed and the corrected amount of feed after the time when the corrected amount of feed is set previously and until the corrected amount of feed is set currently is equal to a predetermined number of times, the feeding mode is judged as being a down mode when the number of times of actual settings is in excess of the predetermined number of times, or the feeding mode is judged as being an up mode when the number of times of actual settings is less than the predetermined number of times, the correcting means being operable to correct the usual amount of feed and the corrected amount of feed by zero in the normal mode, to correct the usual amount of feed and the corrected amount of feed by adding a predetermined correcting amount in the down mode, or to correct the usual amount of feed and the corrected amount of feed by subtracting a predetermined correcting amount in the up mode. In this case, when the mark pitch is equal to the predetermined reference amount of feed, the feeding mode is judges as being the normal mode, and the web is fed by the usual amount of feed and the corrected amount of feed, as zero-corrected. If the mark pitch is in excess of the reference amount of feed, the feeding mode is judged as being the down mode, and the web is fed by the usual amount of feed and the corrected amount of feed which are corrected by subtraction. If the mark pitch is less than the reference amount of feed, the feeding mode is judged as being the up mode, and the web is fed by the usual amount of feed and the corrected amount of feed, as corrected by addition. Thus, the differences in the mark pitch can be handled widely by corrected amounts.

The present invention provides a packaging machine comprising a tube forming device for forming a tube from a web bearing marks thereon with a pitch corresponding to the length of one container, a filling device for filling the tube with contents, and a container forming device for forming pillowlike containers by sealing and severing the filled tube transversely thereof while transporting the tube a distance at a time which distance corresponds to the length of one container, the container forming device comprising a pair of openable flaps for folding a pair of triangular ears in forming the pillowlike container, a drive mechanism for opening the flaps to an adjustable degree and closing the flaps, and a web position matching system for controlling the drive mechanism so as to match the mark to a reference position, the drive mechanism having first and second fluid pressure cylinders, the first fluid pressure cylinder being operable to open the flaps to a first degree and close the flaps, the second fluid pressure cylinder being operable to open the flaps to a second degree resulting from the first degree by correction and close the flaps.

With the packaging machine of the invention, the flaps are opened over the wide ranges of first and second opening degrees so as to control the feed of the web in widely varying amounts.

When the first and second fluid pressure cylinders are so connected as to provide power transmission paths in series, one of the first and second opening degrees is variable with the other opening degree fixed to facilitate the control of the amount of feed of the web.

Preferably, the packaging machine is provided with the web position matching system described.

DESCRIPTION OF THE PREFERRED EMBODIMENT

Figure 1:
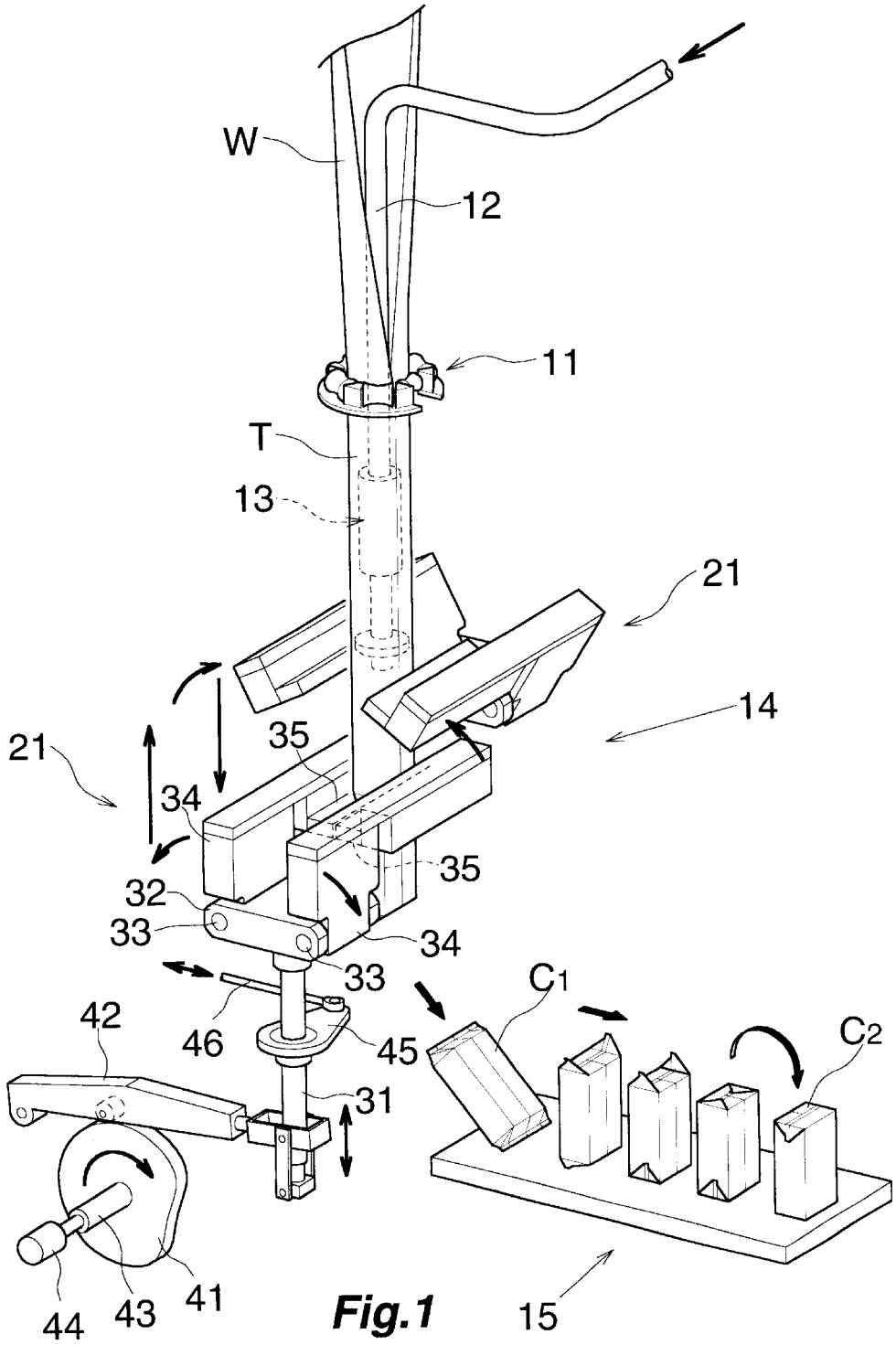
FIG. 1 is a fragmentary perspective view of a packaging machine embodying the invention.

An embodiment of the invention will be described below with reference to the drawings.

In the following description, the terms "front" and "rear" are used based on FIG. 2; the front side of the plane of the drawing will be referred to as "front," and the opposite side thereof as "rear." The terms "left" and "right" are used for the machine as it is seen from the front; the left and right sides of the machine are referred to as "left" and "right," respectively (left-hand side and right-hand side of FIG. 2).

FIG. 1 shows a packaging machine which comprises a tube forming device 11 for making a web W into a tube T, a filling device 13 having a vertical filling pipe 12 inserted into the tube T for filling contents into the tube T to a specified level, an uncompleted container forming device 14 for forming uncompleted pillowlike containers C1 from the filled tube T by sealing and cutting the tube T while forwarding the filled tube T a distance at a time which distance corresponds to the approximate length of one container, and a completed container forming device 15 for forming the uncompleted container C1 into an eventually completed rectangular parallelepipedal container C2.

Figure 2:
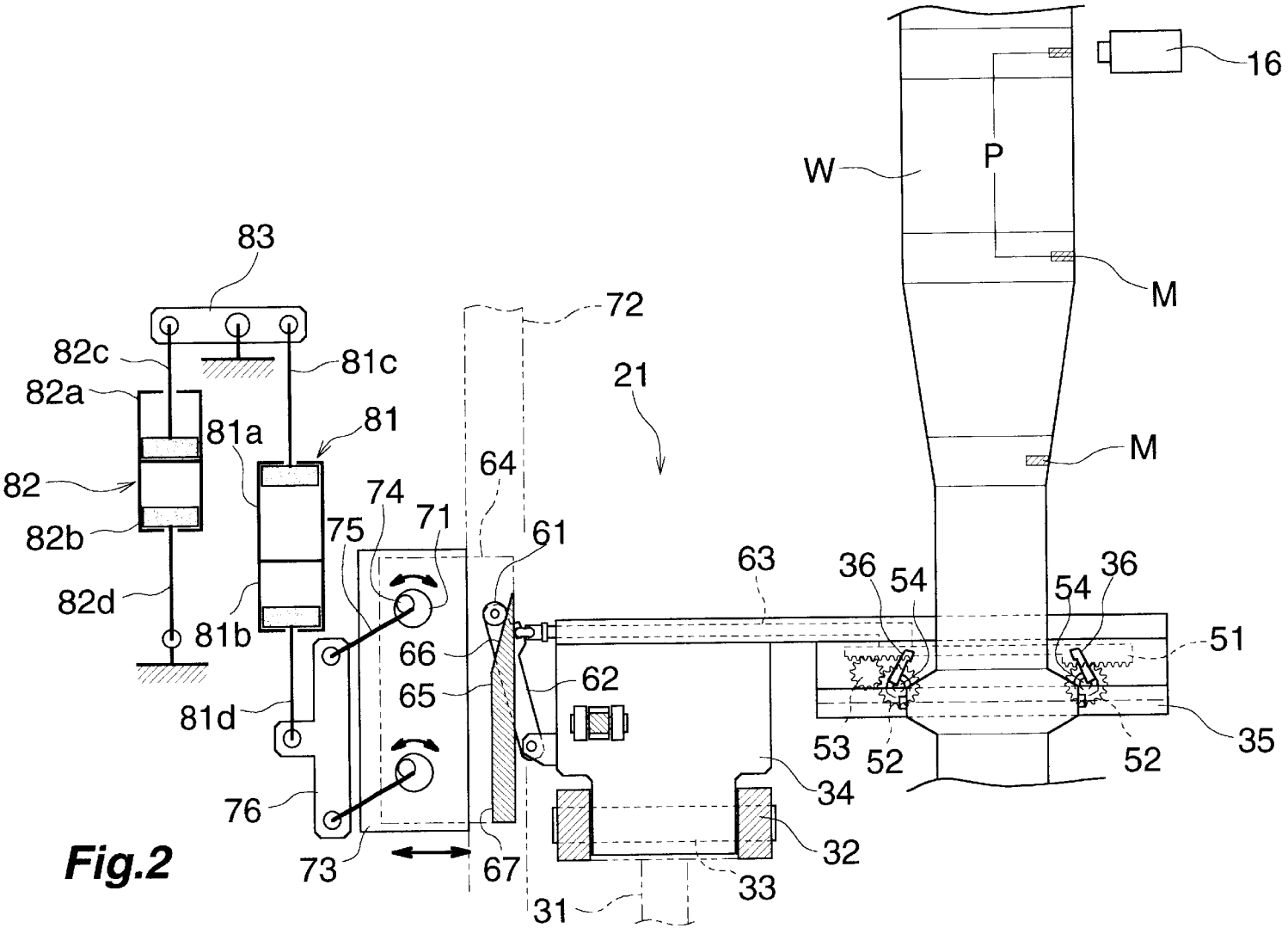
FIG. 2 is a front view showing an uncompleted container forming device of the machine and the vicinity thereof.

With reference to FIG. 2, the web W bears on an edge portion thereof resist marks M arranged with a given pitch P. The pitch P of marks M corresponds to the length of one container. A photosensor 16 for detecting the mark M is disposed a short distance upstream from the uncompleted container forming device 14.

The uncompleted container forming device 14 has a pair of left and right forming units 21. The two forming units 21 have the same construction although facing toward opposite directions laterally of the machine. A description will be given below of the left forming unit shown in detail in FIG. 2.

The forming unit 21 comprises a movable frame 32 movable upward and downward with a vertical lift rod 31, a pair of front and rear pivotal arms 34 attached at their lower portions to the movable frame 32 by a pair of parallel horizontal support rods 33 extending leftward or rightward (i.e., transversely of the unit 21), a pair of front and rear jaws 35 opposed to each other and secured to upper portions of the respective pivotal arms 34, and a pair of left and right folding flaps 36 attached to the rear pivotal arm 34 so as to be positioned over the jaws 35.

The lift rod 31 is driven upward and downward by a cam 41 and a cam follower 42. The cam 41 is secured to a cam shaft 43 which is driven by an unillustrated main shaft. The cam shaft 43 is provided with an encoder 44. An arm 45 is attached to the lift rod 31 so as to permit the rod 31 to move upward and downward while arresting the rotation of the rod. The arm 45 is pivotally moved by a rod 46, whereby the lift rod 31 is rotated. The rotation of the lift rod 31 opens and closes the pair of pivotal arms 34 along with the jaws 35.

Figure 3:
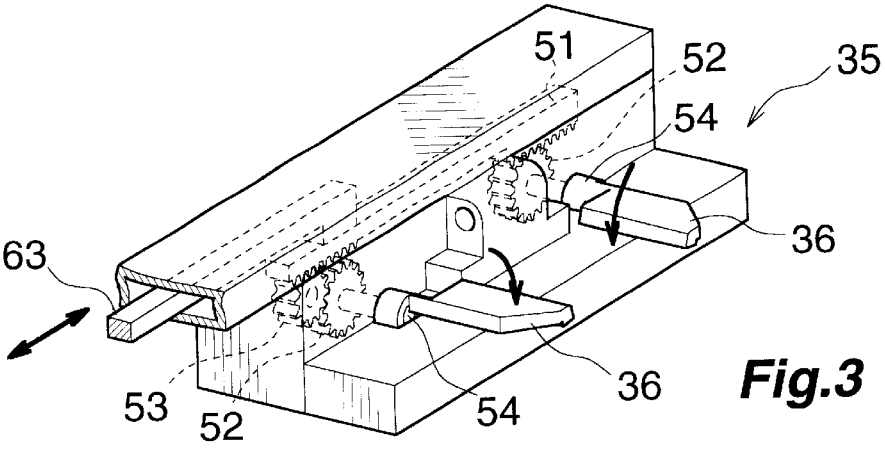
FIG. 3 is a perspective view of folding flaps of the device and the surroundings thereof.

The flaps 36 are each in the form of a triangular plate and opened to a raised position and closed to a fallen position at the same time by a flap operating mechanism shown in FIG. 3.

The rear pivotal arm 34 has incorporated therein a rack 51 extending transversely of the unit 21, and a pair of left and right pinions 52. The left pinion 52 is in mesh with an idle pinion 53 meshing with the rack 51, with which the right pinion 52 meshes directly. Each pinion 52 is fixed to a rotary shaft 54 having the flap 36 fixed thereto at its base portion.

A movable roller plate 62 carrying a roller 61 at its upper end is supported pivotally movably transversely of the unit 21 at its lower end to a left side portion of the rear pivotal arm 34. The roller plate 62 is connected at an upper portion thereof to the left end of the rack 51 by a rod 63. The roller 61 is in contact with a cam surface 65 of a cam plate 64 from the left side thereof. The cam surface 65, facing leftward and extending vertically, comprises an upper slanting face 66 extending upwardly rightward and a lower vertical face 67.

The cam plate 64 is supported by a pair of upper and lower rotary rods 71 extending through a support block 73 longitudinally of the unit 21. The block 73 is provided at the midportion of height of the left side face of a post 72 extending upright in front of and adjacent to the cam plate 64. Each rotary rod 71 has an eccentric pin 74 at its rear end. The eccentric pins 74 are slidably fitted in the cam plate 64. A pair of upper and lower operating arms 75 are fixed each at its base portion to the front ends of the rotary rods 71, respectively. A connecting bar 76 is connected between the forward ends of the operating arms 75. First and second fluid pressure cylinder units 81, 82 exert a fluid pressure on the connecting bar 76.

The first fluid pressure cylinder unit 81 comprises a first upper cylinder 81*a* and a first lower cylinder 81*b* which are joined in series as arranged one above the other, a first upper rod 81*c* projecting upward from the first upper cylinder 81*a* and a first lower rod 81*d* projecting downward from the first lower cylinder 81*b*. The first upper cylinder 81*a* is greater than the first lower cylinder 81*b* in stroke.

Like the first fluid pressure cylinder unit 81, the second fluid pressure cylinder unit 82 comprises a second upper cylinder 82*a* and a second lower cylinder 82*b* which are joined in series as arranged one above the other, a second upper rod 82*c* projecting upward from the second upper cylinder 82*a* and a second lower rod 82*d* projecting downward from the second lower cylinder 82*b*. The stroke of the second upper cylinder 82*a* is equal to that of the second lower cylinder 82*b*.

Figure 4:
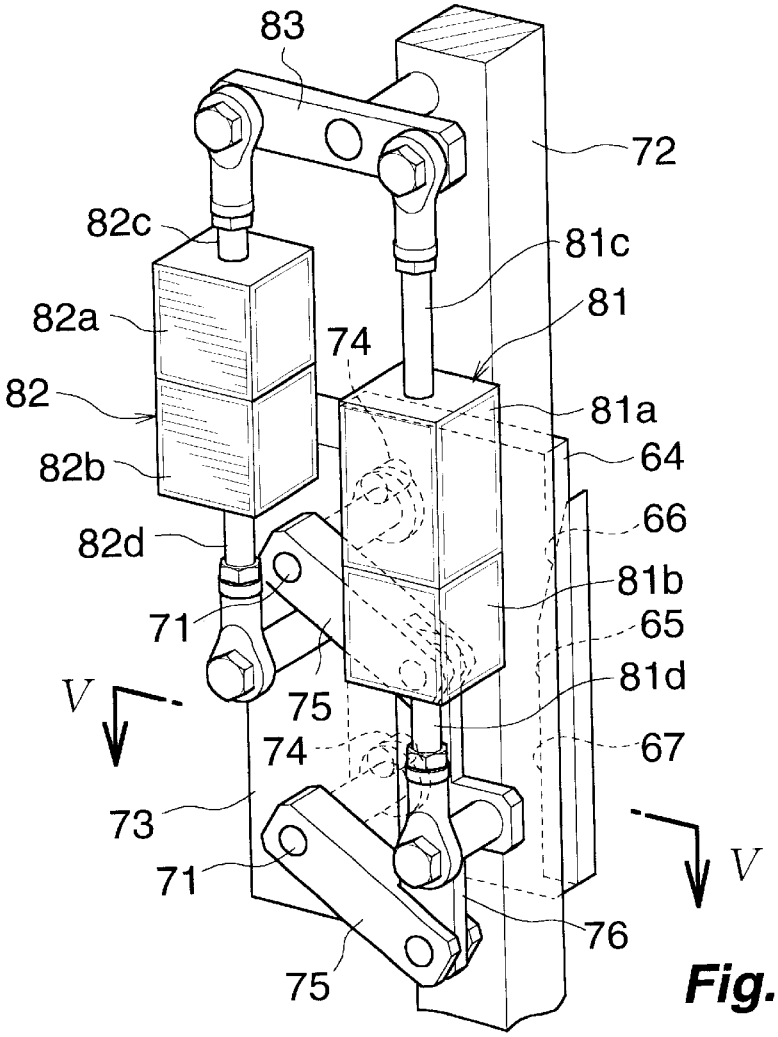
FIG. 4 is a perspective view of a flap operating mechanism of the device.
Figure 5:
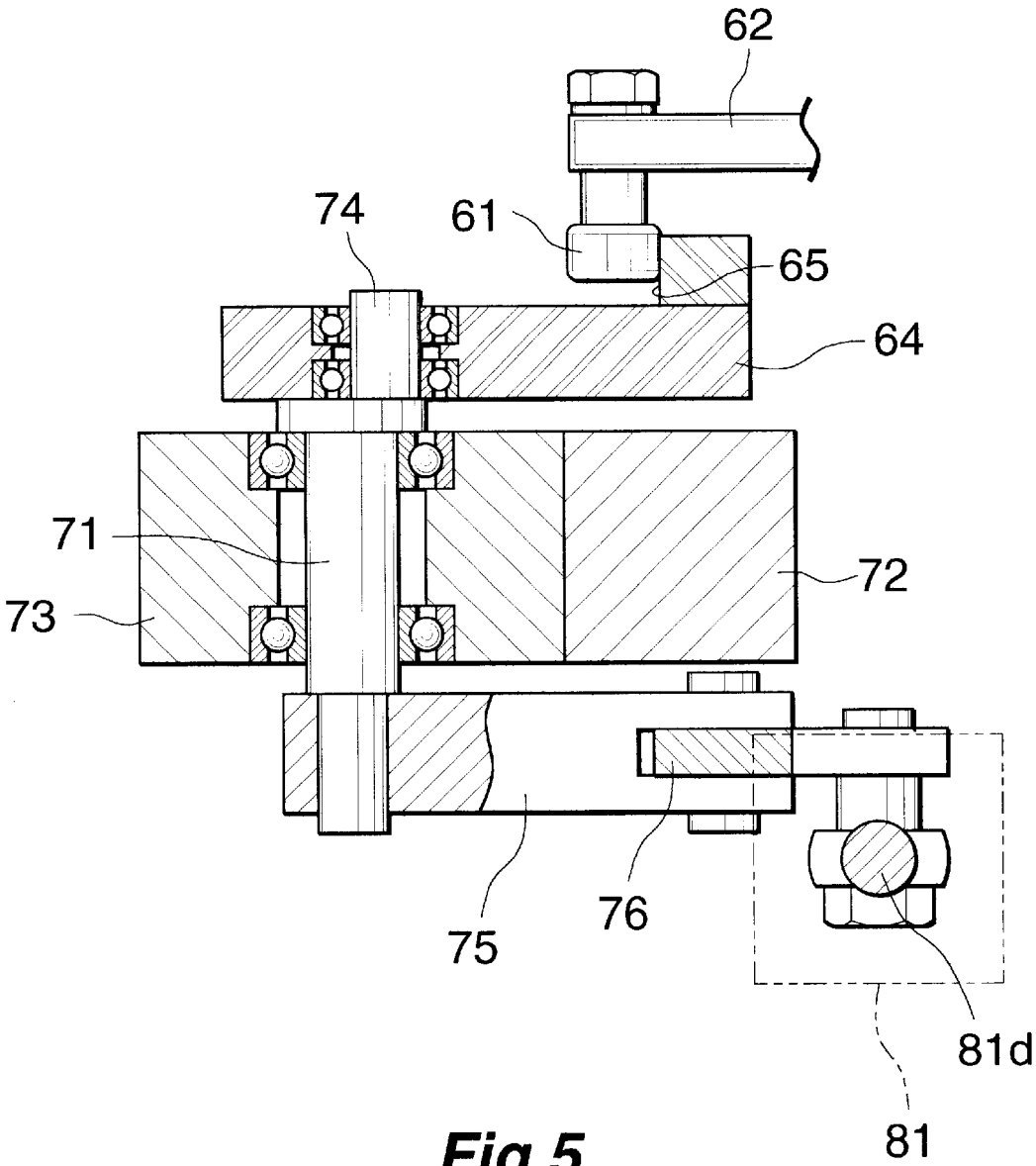
FIG. 5 is a view in section taken along the line V-V in FIG. 4.

With reference to FIG. 4, the lower end of the first lower rod 81*d* is connected to the midportion of length of the connecting bar 76. The upper end of the first upper rod 81*c* is connected to the right end of a lever 83 extending transversely of the unit 21 and supported by the post 72 so as to be positioned above the support block 73. The left end of the lever 83 is connected to the upper end of the second upper rod 82*c*. The lower end of the second lower rod 82*d* is connected to the support block 73.

From the viewpoint of the power transmission path from the support block 73 to the connecting bar 73, the first and second fluid pressure cylinder units 81, 82 are connected in series.

When the roller plate 62 is lowered while being moved upward and downward along with the pivotal arm 34, with the roller 61 bearing on the dam surface 65, the roller 61 is rolled down the slanting face 66 of the cam surface 65 relative thereto, whereby the roller plate 62 is pivotally moved counterclockwise in FIG. 2. As a result, the rack 51 is moved leftward, the left pinion 52 is rotate clockwise, and the right pinion 52 is rotated counterclockwise to close the flaps 36 with each flap rotated in the same direction as the corresponding pinion. The two flaps 36 are in a closed limit position when the roller 61 is positioned on the vertical face 67.

The upward or downward stroke of the jaws 35 corresponds to the approximate length of one container. A distance, for example, about 8 mm shorter than this stroke length will be referred to as the "main amount of feed."

When closing, the flaps 36 collapse the portions of the web to be made into ears of a container, whereby the web W is pulled downward and transported downward. This will be referred to as the "amount of auxiliary feed." The auxiliary amount of feed is added to or subtracted from the main amount of feed to provide an amount of feed corresponding to one container. The amount of auxiliary feed is dependent on the angle at which the flaps 36 are opened or closed, i.e., on the position of the cam plate 64 with respect to the transverse direction, and is adjusted in the following manner by altering the position of the cam plate 64 transversely of the unit 21.

When the operating arms 75 are pivotally moved by the operation of the first and second fluid pressure cylinder units 81, 82, the rotary rods 71 rotate, consequently moving the cam plate 64 by the eccentric pins 74 transversely of the unit 21.

Figure 6:
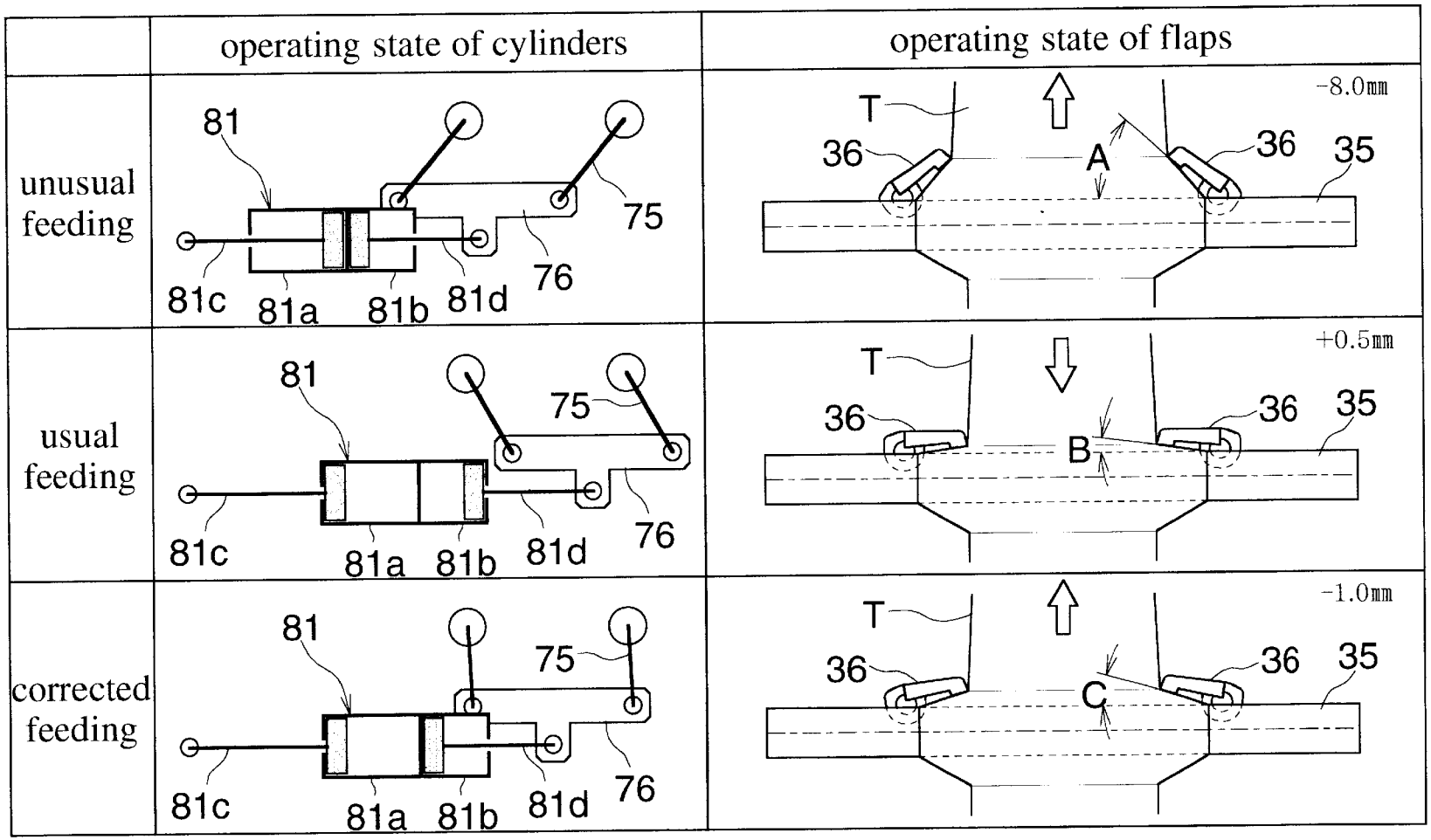
FIG. 6 is a diagram for illustrating the operating states of a first cylinder unit of the flap operating mechanism.

FIG. 6 shows the relationship between the operating state of the first fluid pressure cylinder unit 81 and the corresponding folding angle of the flaps 36.

In an unusual feeding operation, the first upper and lower rods 81*c*, 81*d* are both in a retracted position. The flaps 36 are open at a relatively large angle A. The flaps 36 in this state perform almost no folding operation, and the amount of feed of the web W at this time is 8 mm smaller than a reference amount of feed corresponding to the length of one container. This is a case wherein the mark M is displaced from a reference position greatly, and the mark M is to be brought toward the reference position quickly by this type of operation.

In a usual feeding operation, the first upper and lower rods 81*c*, 81*d* are both advanced, and the flaps are closed to an approximately horizontal position at an angle B. The amount of feed of the web W at this time is the reference amount of feed plus an amount of advance +0.5 mm. This amount will be referred to as the "usual amount of feed."

In a corrected feeding operation, the first upper rod 81*c* is advanced but the first lower rod 81*d* is retracted. The flaps 36 are closed at an angle slight larger than the angle B at the time of the usual feeding operation. The amount of feed of the web at this time is the reference amount of feed minus an amount of delay 1.0 mm. This amount of feed will be referred to as the "corrected amount of feed."

The distance from the outer end of the first upper rod 81*c* to the outer end of the first lower rod 81*d* will be referred to as the "cylinder length." The cylinder lengths in the states shown in FIG. 6 are small, great and medium in the order of the unusual feeding operation, usual feeding operation and corrected feeding operation.

Figure 7:
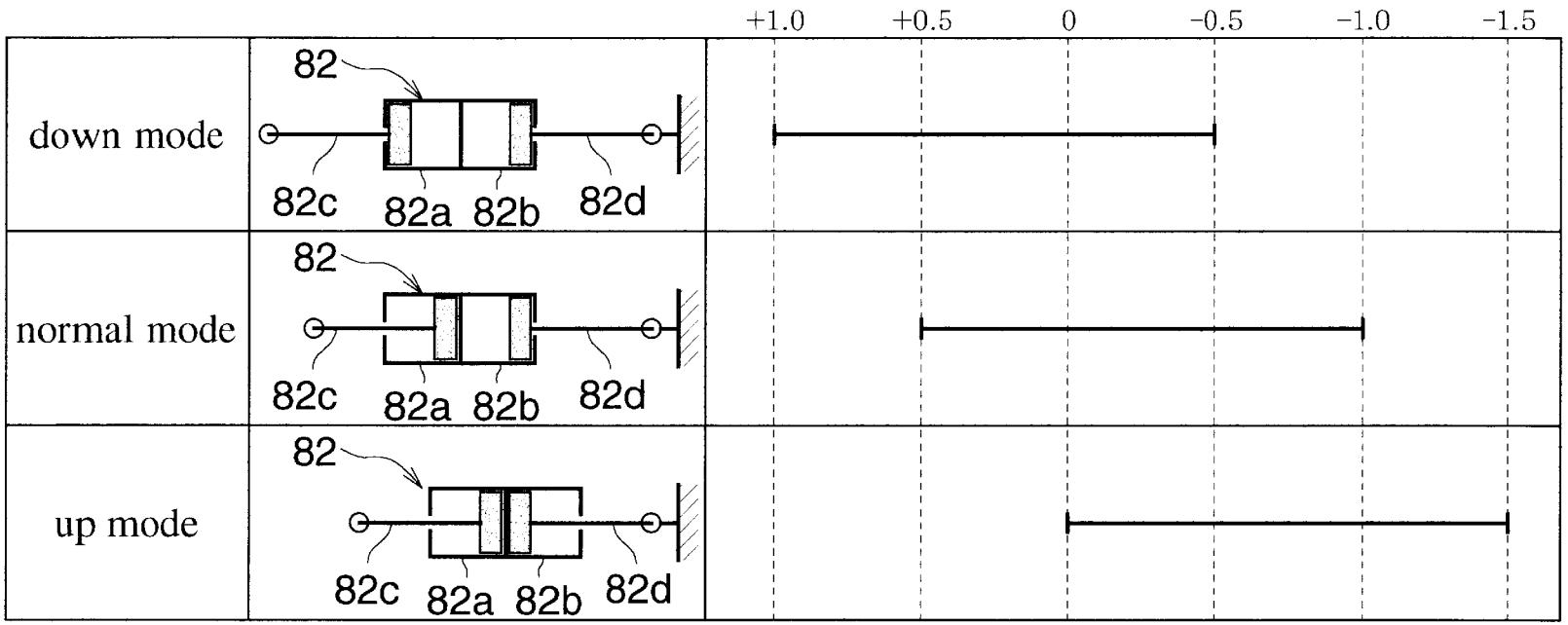
FIG. 7 is a diagram for illustrating the operating states of a second cylinder unit of the flap operating mechanism.

FIG. 7 shows the operating states of the second fluid pressure cylinder unit 82. In the above-mentioned power transmission path, the cylinder length of the first fluid pressure cylinder unit 81 is increased or decreased by the second fluid pressure cylinder unit 82 for correction, whereby the amount of feed of the web W is set in a normal mode, down mode or up mode.

In the normal mode, the second upper rod 82*c* is retracted, with the second lower rod 82*d* advanced. The cylinder length at this time is medium. In the down mode, the second upper and lower rods 82*c*, 82*d* are both advanced. The cylinder length is great in the up mode, the second upper and lower rods 82*c*, 82*d* are both retracted. The cylinder length is small.

The cylinder length in the normal mode is so determined as to correct the amount of feed by zero. The amount of feed is then corrected positively in the down mode, while in the up mode the amount of feed is corrected negatively.

In the normal mode, the amount of advance is +0.5 mm, and the amount of delay −1.0 mm. If the amount of correction is ±0.5 mm, correction is so made that the amount of advance is +1.0 mm, with −0.5 mm for the amount of delay in the down mode. In the up mode, the amount of advance is 0 mm, with −1.5 mm for the amount of delay.

Figure 8:
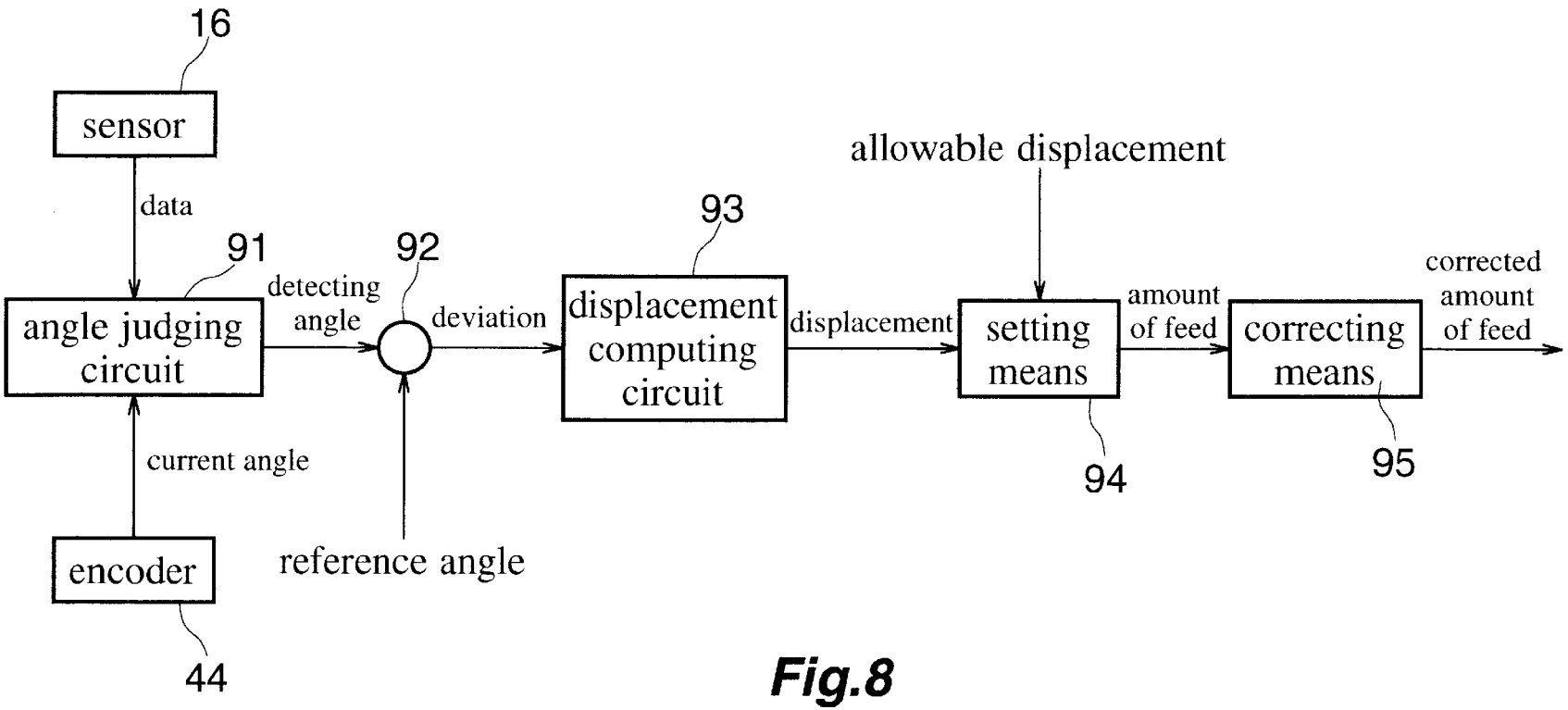
FIG. 8 is a block diagram of means for setting the amount of feed of a web and correcting means.

How to determine the amount of feed of the web will be described with reference to FIG. 8.

When a mark M on the web W moves past the sensor 16, the sensor 16 reads the mark. The data read by the sensor 16 is fed to an angle judging circuit 91. On the other hand, the angle of rotation of the cam shaft 43 detected by the encoder 44 is fed to the angle judging circuit 91. The angle of rotation of the dam shaft 43 at the time when the data read by the sensor 16 is fed to the circuit 91 is interpreted as a mark detecting angle by the circuit 91. The detecting angle is fed to a subtracter 92. The subtracter 92 calculates the deviation of the detecting angle from a reference angle fed thereto. The deviation is fed to a displacement computing circuit 93, which determines a displacement corresponding to the deviation.

The displacement is fed to setting means 94. On the other hand, an allowable displacement is fed to the setting means 94. If the input displacement is less than the allowable displacement, the setting means 94 judges that the current mode is an advance side feed mode, while if the input displacement is not smaller than the allowable displacement, the means 94 judges that the current node is a delay side feed mode. In the case of the advance side feed mode, the usual amount of feed is set which is the reference amount of feed corresponding to the length of one container plus an amount of advance +0.5 mm. In the case of the delay side feed mode, the corrected amount of feed is set which is the reference amount of feed minus the amount of delay 1.0 mm.

Alternatively, the displacement of the mark is detected by the procedure to be described below.

The mark has a definite length in the feeding direction. The sensor is so adapted as to detect the mark over a length range corresponding to the allowable displacement. On the other hand, a reference signal is prepared at an interval corresponding to the length of one container. If the sensor detects the mark when the reference signal is transmitted, a judgement is made that the displacement of the mark is within the allowable displacement, whereas if the sensor then fails to detect the mark, the displacement of the mark is found to be in excess of the allowable displacement.

The amount of feed set by the setting means 94 is checked as to whether it is normal mode, down mode or up mode, and the amount of feed is corrected based on the check result by correcting means 95.

Figure 9A:
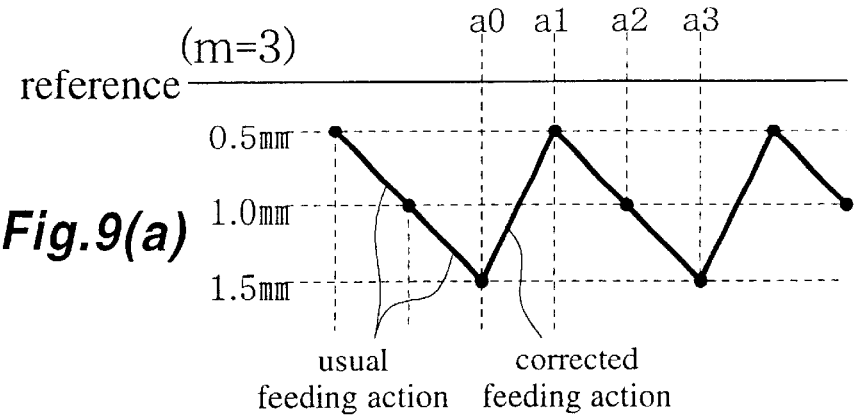
FIG. 9 includes diagrams for illustrating web feeding operations.
Figure 9B:
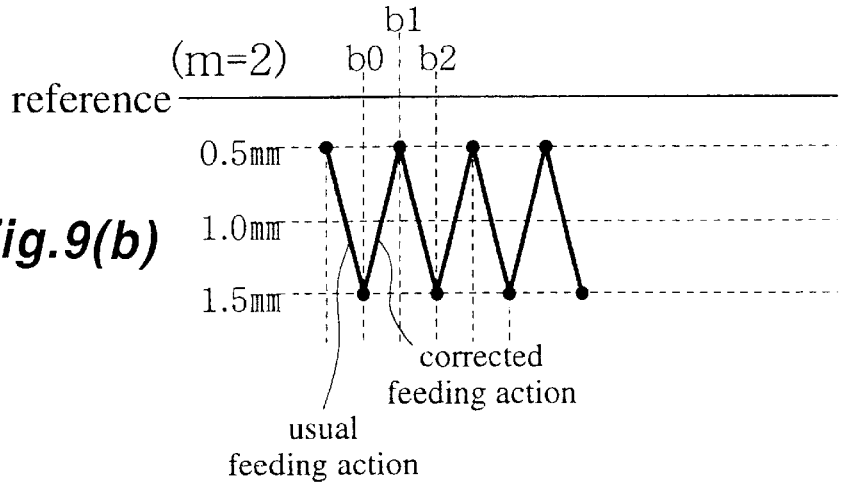
Figure 9C:
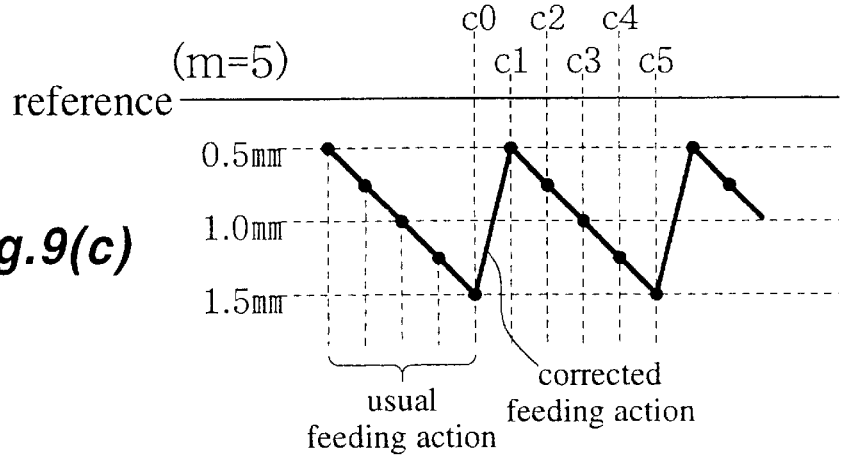

FIG. 9 shows feeding operations to be performed on the assumption that the web W is to be fed in the normal mode based on the amount of feed set by the setting means 94. The amount of advance is +0.5 mm, the amount of delay is −1.0 mm, and the allowable displacement is 1.5 mm.

FIG. 9(*a*) shows a case wherein the pitch P of marks M involves no error, and the mark pitch P is in match with the reference amount of feed. The web W is fed, with the mark M displaced downstream by an amount of advance of +0.5 mm by one usual feeding action. When the web is forwarded twice, the displacement reaches the allowable displacement of 1.5 mm, so that the usual feeding operation is changed over to a corrected feeding operation to perform a corrected feeding action once. In this way, in performing three consecutive feeding actions, two usual feeding actions are conducted in succession, followed by a corrected feeding action only once. This procedure is repeated.

FIG. 9(*b*) shows a case wherein the pitch P of marks M involves an error, and the mark pitch P is shorter than the reference amount of feed by 0.5 mm. The web is fed by the usual feeding operation excessively apparently by an amount corresponding to this amount. An amount of feed obtained by adding the sum of this excessive amount of 0.5 mm and an amount of advance of +0.5, i.e., 1.0 mm, to the reference amount of feed is an apparent amount of feed in the usual feeding operation. When the web W is fed once in this case, the displacement immediately reaches the allowable displacement, whereupon the operation is changed to a corrected feeding operation. Two consecutive feeding actions are one usual feeding action and one corrected feeding action, which are performed alternately.

If the error of marks M is in excess of 0.5 mm, it appears likely that the line of waveform shown in FIG. 9(*b*) will gradually shift downward, making it impossible to match the mark M to the reference position.

FIG. 9(*c*) shows a case wherein the pitch P of marks M involves an error, and the mark pitch P is longer than the reference amount of feed by 0.25 mm. The apparent amount of feed is a value obtained by subtracting 0.25 mm from the amount of advance +0.5 mm and adding the resulting amount 0.25 mm to the reference amount of feed. When a usual feeding action is performed four times consecutively, the displacement reaches the allowable displacement, whereupon a corrected feeding operation is conducted for the first time. Accordingly in five consecutive repetitions of feeding action, four usual feeding actions are followed by a corrected feeding action only once.

With these three types of operations in mind, a mode deciding procedure will be described with reference to the flow chart of FIG. 10.

In starting to feed the web W, the amount of feed is set in the normal mode in step S11. Mark detecting frequency m and mark correcting action frequency n are each set at an initial value of 0 in step S12. A mark detecting signal is input in step S13, and the mark detecting frequency m is set at 1 in step S14. An inquiry is made in step S15 as to whether the displacement of the mark is less than the allowable amount. If the answer is affirmative, step S16 follows, in which the mark correcting action frequency n is checked as to whether it is 1. If the frequency n remains to be the initial value of 0, step S17 follows for usual feeding operation. If the displacement of the mark is not smaller than the allowable value, step S18 follows for a collected feeding action, and the frequency n is set at 1 in step S19, whereupon sequence proceeds from step S16 to step S20 to inquire whether the mark detecting frequency m is greater than 3. If the answer is affirmative, the amount of feed is set in the down mode. If the frequency m is not greater than 3, step S22 follows, in which an inquiry is made as to whether the frequency m is smaller than 3 or equal to 3. When the frequency m is smaller than 3, the up mode is set in step S23, or when the frequency m is equal to 3, the normal mode is set in step S24.

Figure 10:
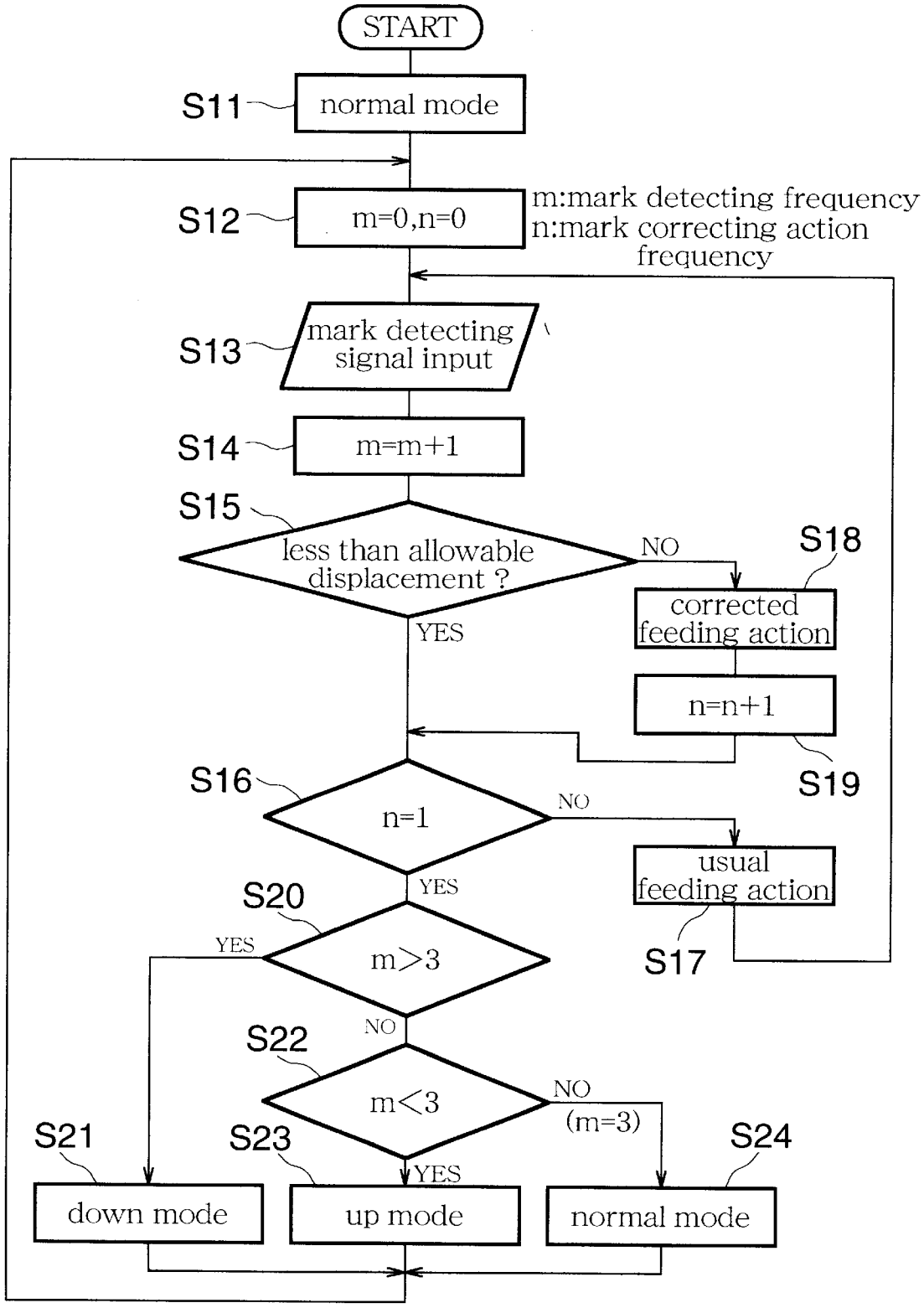
FIG. 10 is a flow chart showing a procedure for correcting the amount of feed of the web.

With reference to FIG. 9 again in addition to FIG. 10, it is assumed that in FIG. 9(*a*), a0 is the time when the previous correcting action was made, and that a3 is the time when current collecting action is to be made.

Since the time a0 corresponds to step S15 of FIG. 10, a corrected feeding action is thereafter made in S18, one of the three modes is set, and the mark detecting frequency m and the mark correcting action frequency n are set to the initial value of 0 in step S12.

At time al, the mark detecting signal is fed in step S13, and the frequency m is set at 1 in step S14. The displacement is checked in step S15. Since the displacement is less than the allowable value, step S16 follows. Since the frequency n is not 1, a usual feeding action is performed in step S17.

At time a2, the mark detecting frequency m is set at 2 in step S14, followed by step S15 to check the displacement. Since the displacement is less than the allowable value, the sequence proceeds to step S16 and then to step S17, in which a usual feeding action is conducted the second time.

AT time a3, the mark detecting frequency m is set at 3 in sep S14. Since the displacement is found to be equal to the allowable amount in step S15, the sequence then proceeds to step S18 for a corrected feeding operation. The mark correcting action frequency n is set at 1 in step S19. The sequence proceeds from step S16 to step S20 and then to step S22. Since the frequency m is 3 in step S22, the normal mode is set again in step S24.

Next, FIG. 9(*b*) will be checked. With reference to FIG. 9(*b*), b0 is the time when the previous correcting action is performed, and b2 is the time when the correcting action is to be performed currently.

At time b1, the mark detecting frequency m is set at 1. Since the displacement is less than the allowable amount, step S16 follows, and a usual feeding action is performed in step S17.

At time b2, the frequency m is set at 2, the displacement is checked in step S15. Since the displacement is equal to the allowable amount, the sequence proceeds to step S18, in which a corrected feed action is performed. The mark correcting action frequency n is set at 1 in step S19. The sequence proceeds from step S16 to step S20 and then to step S22, in which the frequency m is checked. Since the frequency m is less than 3, step S23 follows to set the up mode.

With reference to FIG. 9(*c*), c0 is the time when the previous correcting action is conducted, and c5 is the time when the current correcting action is to be conducted. A usual feeding action is performed four times in succession at time points c1 to c4 as described above, so that the description will not be repeated.

At time c5, the frequency m is set at 5. Step S15 is followed by step S18 for a corrected feeding action, and the frequency n is set at 1 in step S19. Since the frequency m is greater than 3, step S20 is followed by step S21 to set the down mode.

A change from the normal mode to the up mode means that the pitch of marks M is smaller than the reference amount of feed. Accordingly, the amount of advance of +0.5 mm and the amount of delay of −1.0 mm in the normal mode are corrected to 0 mm and −1.5 mm, respectively, in the up mode to absorb the displacement. Conversely, a change from the normal mode to the down mode means that the mark pitch is greater than the reference amount of feed. To absorb the difference, the amount of advance and the amount of delay as corrected to +1.0 mm and −0.5 mm, respectively, are used in the down mode.

Although the limit for the absorption of errors in the mark pitch P is ±0.5 mm in the normal mode, the errors in the pitch P absorbable are up to −1.0 mm in the up mode, and the corresponding limit value in the down mode is +1.0 mm.

The resist marks used for detecting the displacement of the web may be replaced by straw holes, bar codes, etc.

Although the second fluid pressure cylinder unit 82 is used for adjusting the usual amount of feed and the corrected amount of feed in the three modes of normal mode, down mode and up mode, the unit 82 can be replaced by suitable drive means, such as a motor (servomotor or pulse motor), for driving the lever 83 to adjust the usual amount of feed and the corrected amount of feed in at least three steps or steplessly, whereby the amount of feed of the web can be controlled more finely as required.

What is claimed is:

1. A packaging machine comprising:

a tube forming device for forming a tube from a web bearing marks thereon with a pitch corresponding to the length of one container, a filling device for filling the tube with contents, and a container forming device for forming pillowlike containers by sealing and severing the filled tube transversely thereof while transporting the tube a distance at a time which distance corresponds to the length of one container, the container forming device comprising a pair of openable flaps for folding a pair of triangular ears in forming the pillowlike container, a drive mechanism for opening the flaps to an adjustable degree and closing the flaps, and a web position matching system for controlling the drive mechanism so as to match the mark to a reference position, the drive mechanism having first and second fluid pressure cylinders, the first fluid pressure cylinder being operable to open the flaps to a first degree and close the flaps, the second fluid pressure cylinder being operable to open the flaps to a second degree resulting from the first degree by correction and close the flaps.

2. A packaging machine according to claim 1 wherein the first and second fluid pressure cylinders are so connected as to provide power transmission paths in series.

3. A packaging machine according to claim 1 or 2 wherein the web position matching system comprises:

sensor means for detecting the displacement of the mark from the reference position, setting means for setting a usual amount of feed obtained by adding a predetermined amount of advance to a predetermined reference amount of feed corresponding to the length of one container when the displacement detected by the sensor means is smaller than a predetermined allowable displacement or setting a corrected amount of feed obtained by subtracting a predetermined amount of delay from the reference amount of feed when the detected displacement is not smaller than the allowable displacement, and means for correcting the usual amount of feed and the corrected amount of feed based on a pattern of frequencies with which the usual amount of feed and the corrected amount of feed are set by the setting means, the first fluid pressure cylinder being operable to set the usual amount of feed and the corrected amount of feed, the second fluid pressure cylinder being operable to correct the usual amount of feed and the corrected amount of feed.

4. A packaging machine comprising:

a tube forming device for forming a tube from a web bearing marks thereon with a pitch corresponding to the length of one container, a filling device for filling the tube with contents, and a container forming device for forming pillowlike containers by sealing and severing the filled tube transversely thereof while transporting the tube a distance at a time which distance corresponds to the length of one container, the container forming device comprising a pair of openable flaps for folding a pair of triangular ears in forming the pillowlike container, a drive mechanism for opening the flaps to an adjustable degree and closing the flaps, and a web position matching system for controlling the drive mechanism so as to match the mark to a reference position, the drive mechanism comprising first and second fluid pressure cylinders so connected together as to provide power transmission paths in series, operating arms pivotally movable by the first and second fluid pressure cylinders, rotary rods having the respective operating arms fixed thereto each at an arm base portion and each provided with an eccentric pin, a cam plate having a cam surface and a hole with the eccentric pin slidably fitted therein, a roller rollable on the cam surface, and a rack-pinion mechanism reciprocatingly movable straight by the roller for converting the reciprocating straight movement to a rotary motion and transmitting the motion to the flaps to open and close the flaps.

5. A packaging machine according to claim 4 wherein the web position matching system comprises:

sensor means for detecting the displacement of the mark from the reference position, setting means for setting a usual amount of feed obtained by adding a predetermined amount of advance to a predetermined reference amount of feed corresponding to the length of one container when the displacement detected by the sensor means is smaller than a predetermined allowable displacement or setting a corrected amount of feed obtained by subtracting a predetermined amount of delay from the reference amount of feed when the detected displacement is not smaller than the allowable displacement, and means for correcting the usual amount of feed and the corrected amount of feed based on a pattern of frequencies with which the usual amount of feed and the corrected amount of feed are set by the setting means, the first fluid pressure cylinder being operable to set the usual amount of feed and the corrected amount of feed, the second fluid pressure cylinder being operable to correct the usual amount of feed and the corrected amount of feed.

* * * * *